United States Patent [19]

Hoshino et al.

[11] Patent Number: 4,907,434

[45] Date of Patent: Mar. 13, 1990

[54] METHOD AND DEVICE FOR CONTROLLING STRIP THICKNESS IN ROLLING MILLS

[75] Inventors: Ikuya Hoshino; Hiroshi Kimura; Yukihiro Maekawa; Takayuki Fujimoto, all of Nagoya, Japan

[73] Assignee: Sumitomo Light Metal Industries, Ltd., Japan

[21] Appl. No.: 253,582

[22] Filed: Oct. 4, 1988

[30] Foreign Application Priority Data

Oct. 7, 1987 [JP] Japan ..... 62-253249

[51] Int. Cl.[4] ..... B21B 37/00

[52] U.S. Cl. ..... 72/8; 72/11; 72/16; 72/20; 364/472

[58] Field of Search ..... 72/17, 16, 20, 8, 11; 364/472

[56] References Cited

U.S. PATENT DOCUMENTS

| | | | |
|---|---|---|---|
| 3,248,916 | 5/1966 | Kenyon et al. | 72/16 X |
| 3,592,031 | 7/1971 | Sutton et al. | 72/16 X |
| 3,694,636 | 9/1972 | Smith, Jr. | 72/16 X |
| 4,292,825 | 10/1981 | Morooka et al. | 72/16 X |
| 4,485,497 | 12/1984 | Miura | 72/16 X |

FOREIGN PATENT DOCUMENTS

| | | | |
|---|---|---|---|
| 0162221 | 7/1986 | Japan | 72/16 |
| 62-214818 | 9/1987 | Japan . | |

*Primary Examiner*—W. Donald Bray

*Attorney, Agent, or Firm*—Arnold, White & Durkee

[57] ABSTRACT

The present invention relates to a method and device for controlling a thickness of a strip in a rolling mill which has a roll gap adjusting device and a rolling speed adjusting device. Rolling environment disturbances received by the mill are classified into a first disturbance for which only the rolling speed should be compensated, a second disturbance for which only the roll gap should be compensated, and a third disturbance for which both the rolling speed and the roll gap should be compensated. The values of the first, second and third disturbances are estimated, based on detected values of a variation of a roll force exerted on the given rolling stand, variations of a thickness of the strip on the downstream and upstream sides of the given rolling stand, and a variation of a tension of the strip on the upstream side of the given rolling stand. The roll gap adjusting device and the rolling speed adjusting device are operated, depending upon the estimated values of the first, second and third disturbances, to thereby control the thickness of the strip.

5 Claims, 5 Drawing Sheets

30
32
34
36
38
40
42
44
46
48
50
52
54
$u_s^{(i)}$
$u_v^{(i-1)}$
$h_b^{(i)}$
$\frac{1}{T_s A+1}$
$\frac{1}{T_v A+1}$
$S_c^{(i)}$
$V^{(i-1)}$
$d_s$
$d_v$
$S^{(i)}$
$M_v$
$M_s$
$M_h$
$\frac{1}{A-M_\sigma}$
$\mathcal{E}_s$
$\mathcal{E}_h$
$\mathcal{E}_\sigma$
$d_h$
$h_f^{(i)}$
$\sigma^{(i-1)}$
$\frac{P^{(i)}}{M^{(i)}}$

METHOD AND DEVICE FOR CONTROLLING STRIP THICKNESS IN ROLLING MILLS

BACKGROUND OF THE INVENTION

1. Field of the Invention

The present invention relates in general to a method and a device for controlling the thickness of a strip being rolled by a rolling mill, and more particularly to improvements in the strip thickness control method and device for the rolling mill.

2. Discussion of the Related Art

In a known rolling mill, the thickness of a strip being rolled is controlled by adjusting the roll gap which is defined by work rolls at a rolling stand. When the strip thickness is controlled by regulating only the roll gap, the tension of the strip, particularly the strip tension measured on the upstream side of the rolling stand tends to be varied. This variation in the strip tension adversely affects the thickness of the strip. Therefore, it has been considered necessary to regulate the strip tension, as well as the roll gap, for accurately controlling the strip thickness.

In view of the above, the conventional control system for a rolling mill is adapted to control both the thickness and the tension of the strip, independently of each other. For example, the strip thickness at a given (i)th rolling stand is controlled by adjusting the roll gap of that (i)th stand, based on a proportioned and integrated value of a variation of the strip thickness which is detected by a suitable detector such as an X-ray thickness gauge. On the other hand, the tension of the strip is controlled by adjusting the rolling speed of an upstream (i−1)th rolling stand, as viewed in the direction of movement of the strip through the rolling mill. An example of such a control arrangement for a rolling mill is indicated in FIGS. 5(*a*) and 5(*b*).

Described more specifically referring to FIG. 5(*a*) which schematically illustrates the conventional control process for controlling the thickness of a strip at a given (i)th rolling stand of a cold tandem rolling mill, reference numeral 2 denotes a hydraulically operated roll gap adjusting actuator or device, while reference numeral 4 denotes a rolling speed adjusting device. These two adjusting devices 2 and 4 are controlled independently of each other. The roll gap adjusting device 2 is provided at the (i)th rolling stand indicated at 6, while the rolling speed adjusting device 4 is provided for a preceding or upstream (i−1)th rolling stand 8. On the downstream or outlet side of the (i)th stand 6, there is provided a thickness gauge 10 such as an X-ray gauge. Further, a tension meter 12 for measuring the tension of the strip is disposed between the (i)th and (i−1)th rolling stands 6, 8.

A proportioned and integrated value of a thickness variation detected by the gauge 10 is fed back to control the roll gap adjusting device 2 for adjusting the roll gap of the (i)th stand 6. In the meantime, a proportioned and integrated value of a tension variation detected by the tension meter 12 is fed back to the rolling speed adjusting device 4 for adjusting the rolling speed of the strip. The block diagram of FIG. 5(*b*) shows control arrangements for obtaining a roll gap command value $U_s^{(i)}$ and a rolling speed command value $U_v^{(i-1)}$ for controlling the devices 2 and 4. In the block diagram, $h_f^{(i)}$ represents a variation of the thickness of the strip detected by the thickness gauge 10 on the downstream side of the stand 6, while $\sigma^{(i-1)}$represents a variation of the tension of the strip detected by the tension meter 12 on the upstream side of the (i)th stand 6. $K_p^{(i)}$ represents a proportion constant, while $K_I^{(i)}$ represents an integration constant. Reference numerals 14, 16, 18 and 20 designate gain setters, while reference numerals 22 and 24 designate integrators.

In the control arrangement indicated above, however, the rolling environment disturbances received by the rolling mill cause a variation of the strip tension, which in turn unnecessarily causes a change in the rolling speed. Therefore, it takes a considerably long time until the roll gap is properly adjusted, and this indicates inaccurate control of the strip thickness.

In the light of above drawback experienced in the prior art thickness control arrangement for a rolling mill, the present applicants proposed a highly accurate strip thickness control arrangement wherein the roll gap adjusting device and the rolling speed adjusting device are simultaneously controlled, as disclosed in laid-open publication No. 62-214818 of unexamined Japanese patent application, which was published on Sept. 21, 1987.

Described more particularly, the strip thickness control arrangement disclosed in the above-identified publication is adapted to control the roll gap adjusting device and the rolling speed adjusting device of a rolling mill, such that the rolling environment disturbances received by the rolling mill are classified into a first disturbance for which only the rolling speed should be compensated, a second disturbance for which only the rolling gap should be compensated, and a third disturbance for which both the rolling speed and the roll gap should be compensated, and such that the thus classified first, second and third disturbances are estimated based on detected values of variations of the strip thickness on the downstream side of an appropriate rolling stand, tension of the strip on the upstream side of the stand, and the roll force of the stand. Based on the estimated values of the first, second and third disturbances, the rolling speed and roll gap adjusting devices are simultaneously controlled so as to maintain the strip thickness at a predetermined value, irrespective of the disturbances.

In the proposed thickness control arrangement, only the thickness information measured by a thickness gauge disposed on the downstream or outlet side of the appropriate rolling stand is used for controlling the thickness of the strip on the same side of the stand. Further study and research by the applicants revealed that this thickness information was insufficient for accurate regulation of the strip thickness. Thus, the applicants found it necessary to improve their earlier proposed strip thickness control arrangement of a rolling mill.

SUMMARY OF THE INVENTION

It is accordingly a first object of the present invention to provide a strip thickness control method for a rolling mill, which is improved over the earlier proposed method disclosed in the above-identified laid-open publication No. 62-214818, that is, to provide a strip thickness control method by which the rolling environment disturbances can be more accurately estimated to compensate the rolling speed and roll gap for the estimated disturbances, for thereby highly accurately controlling the strip thickness.

A second object of the invention is to provide a control device for practicing the method of the invention.

The first object may be achieved according to one aspect of the present invention, which provides a method of controlling a thickness of a strip in a rolling mill which has a roll gap adjusting device for adjusting a roll gap of a given rolling stand of the mill, and a rolling speed adjusting device for adjusting a rolling speed of the strip, comprising the steps of: detecting a variation of a roll force exerted on the given rolling stand, a variation of a thickness of the strip on an upstream side of the given rolling stand, a variation of a thickness of the strip on a downstream side of the given rolling stand, and a variation of a tension of the strip on the upstream side of the given rolling stand; classifying rolling environment disturbances received by the rolling mill, into a first disturbance for which only the rolling speed should be compensated, a second disturbance for which only the roll gap should be compensated, and a third disturbance for which both the rolling speed and the roll gap should be compensated; estimating values of the first, second and third disturbances, based on the detected variation of the roll force and the detected variations of the thicknesses of the strip on the upstream and downstream sides of the given rolling stand; and operating the roll gap adjusting device and the rolling speed adjusting device, depending upon the estimated values of the first, second and third disturbances, to thereby control the thickness of the strip.

The strip thickness control method according to the present invention as described above effectively reduces the possibility of unnecessarily producing commands for operating the rolling speed and roll gap adjusting devices when the rolling environment disturbances are received by rolling mill. Therefore, the variation in the strip tension due to the disturbances can be generally reduced. In particular, the instant method permits a considerable reduction in variation of the strip thickness which arises from a change in the coefficient of friction between the rolled strip and the work rolls during acceleration and deceleration of the rolling mill.

Since the instant method uses four parameters, i.e., thicknesses on the upstream and downstream side of the appropriate rolling stand, strip tension on the upstream side of the stand, and roll force of the stand the disturbances received by the mill can be accurately estimated, whereby the rolling speed and the roll gap can be accurately compensated for the received disturbances. In summary, the above-indicated advantage of the present method over the method disclosed in the laid-open publication No. 62-214818 is derived mainly from the use of an additional thickness gauge to detect the thickness of the strip on the upstream side of the stand, as well as the thickness on the downstream side of the stand. This additional thickness information is conducive to an improvement in the control accuracy of the thickness of the strip in the rolling mill.

The second object may be achieved according to another aspect of the invention, which provides a device for controlling a thickness of a strip in a rolling mill which has a plurality of rolling stands, comprising: a roll gap adjusting device for adjusting a roll gap of a given one of a plurality of rolling stands, through which the strip is passed for being rolled so as to give the rolled strip a desired value of thickness; a rolling speed adjusting device for adjusting a rolling speed of the strip at a preceding one of the rolling stands which precedes the given rolling stand; roll force detecting means for detecting a variation of a roll force exerted on the given rolling stand; upstream thickness detecting means for detecting a variation of a thickness of the strip on an upstream side of the given rolling stand; downstream thickness detecting means for detecting a variation of a thickness of the strip on a downstream side of the given rolling stand; tension detecting means for detecting a variation of a tension of the strip on the upstream side of the given rolling stand; and arithmetic means responsive to the roll force detecting means, the upstream and downstream thickness detecting means and the tension detecting means, for classifying rolling environment disturbances received by the rolling mill, into a first disturbance for which only the rolling speed should be compensated, a second disturbance for which only the rolling gap should be compensated, and a third disturbance for which both the roll gap and the rolling speed should be compensated, the arithmetic means estimating values of the first, second and third disturbances, based on the detected variations of the roll force, the thicknesses of the strip and the tension, and producing output signals for operating the roll gap adjusting device and the rolling speed adjusting device, depending upon the estimated values of the first, second and third disturbances, to thereby control the thickness of the strip.

The instant control device provides the same advantages as offered by the method of the invention.

BRIEF DESCRIPTION OF THE DRAWINGS

The above and optional objects, features and advantages of the present invention will be better understood by reading the following description of a presently preferred embodiment of the invention, when considered in connection with the accompanying drawings, in which:

FIG. 5(*b*) is a schematic view of a process for determining the roll gap command value and the rolling speed command value, from a strip thickness variation measured at the downstream side of a specific rolling stand, and an interstand tension variation measured between the specific rolling stand and the next rolling stand.

DETAILED DESCRIPTION OF THE PREFERRED EMBODIMENT

Figure 1:
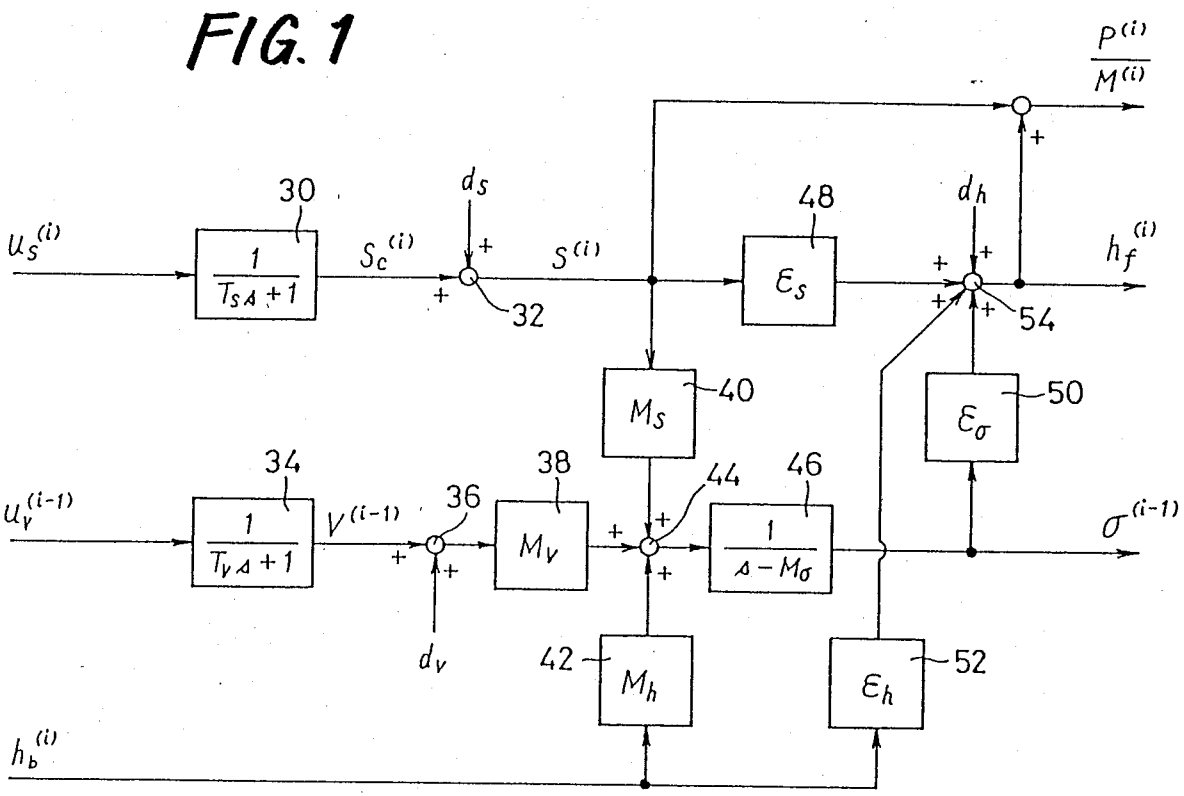
FIG. 1 is a schematic block diagram of a control process for a rolling mill, according to one embodiment of the present invention.

The concept of the present invention as applied to an ordinary cold tandem rolling mill will be described in detail. The rolling mill includes a specific (i)th rolling stand, and an (i−1)th rolling stand positioned next on the upstream or inlet side of that specific (i)th rolling stand. As described below in greater detail, the gist of the present invention lies in the classification of the rolling mill environment disturbances into three types:

$d_s$, $d_v$ and $d_h$, the values of which are estimated, to determine a rolling speed command or input value $U_v^{(i-1)}$ and a roll gap command or input value $U_s^{(i)}$.

Given the above-indicated roll gap command value $U_s^{(i)}$ and rolling speed command value $U_v^{(i-1)}$, the following variables can be detected: (a) a variation $\sigma^{(i-1)}$ of an interstand tension of a strip being rolled, measured between the (i)th and (i−1)th stands (hereinafter referred to as "interstand tension variation"); (b) a variation $h_b^{(i)}$ of the strip thickness measured on the upstream or inlet side of the (i)th stand (hereinafter referred to as "upstream side thickness variation") by an upstream side thickness gauge; (c) a variation $h_f^{(i)}$ of the strip thickness measured on the downstream or outlet side of the (i)th stand (hereinafter referred to as "downstream side thickness variation") by a downstream side thickness gauge; and (d) a variation $P^{(i)}$ of a roll force applied to the (i)th stand (hereinafter referred to as "roll force variation"). These four values will be considered.

The downstream side thickness variation $h_f^{(i)}$ is expressed by the following equation (1):

$$h_f^{(i)} = \epsilon_s \cdot S^{(i)} + \epsilon_\sigma \cdot \sigma^{(i-1)} + \epsilon_h \cdot h_b^{(i)} + d_h \quad (1)$$

where, $h_f^{(i)}$: Downstream side thickness variation $S^{(i)}$: Variation of the roll gap at the (i)th stand $\sigma^{(i-1)}$: Interstand tension variation $h_b^{(i)}$: Upstream side thickness variation $d_h$: Disturbances such as a variation of a material deformation resistance $\epsilon s$, $\epsilon\sigma$, $\epsilon h$: Factors determined by a material to be rolled and other rolling conditions The interstand tension variation $\sigma^{(i-1)}$ is expressed by the following equation (2):

$$\frac{d}{dt}\sigma^{(i-1)} = M_\sigma \sigma^{(i-1)} + M_s S^{(i)} + M_v(V^{(i-1)} + d_v) + M_h \cdot h_b^{(i)} \quad (2)$$

where, $d_v$: Disturbances such as an interstand strip speed variation at the downstream side of the (i−1)th stand caused for example by the material deformation resistance variation and a variation of a friction between the rolls and the material being rolled, and which influence the interstand tension variation $\sigma^{(i-1)}$ $M\sigma$, Ms, Mv, Mh: Factors determined by a material to be rolled and other rolling conditions The downstream side thickness variation $h_f^{(i)}$ is also expressed by the following equation (3):

$$h_f^{(i)} = S^{(i)} + \frac{P^{(i)}}{M^{(i)}} \quad (3)$$

where, $P^{(i)}$: Roll force variation at the (i)th stand $M^{(i)}$: Constant associated with the (i)th stand The roll gap variation $S^{(i)}$ is influenced by factors (disturbances) $d_s$ such as a thermal expansion of the rolls, as well as by a roll gap output value $S_c^{(i)}$ which is determined by the roll gap command value $U_s^{(i)}$ which is applied to a roll gap controller such as a hydraulically operated roll-position changing actuator. The roll gap variation $S^{(i)}$ is expressed by the following equation (4):

$$S^{(i)} = S_c^{(i)} + d_s \quad (4)$$

$$T_s \frac{d}{dt} S_c^{(i)} = -S_c^{(i)} + U_s^{(i)} \quad (5)$$

The above equation (5) represents a linear delay of a dynamic characteristic of the roll gap output value $Sc^{(i)}$ determined by the roll gap command value $U_s^{(i)}$. Ts represents a time constant.

A rolling speed variation $V^{(i-1)}$, and the rolling speed command value $U_v^{(i-1)}$ applied to a rolling speed controller satisfy the following equation (6):

$$T_v \frac{d}{dt} V^{(i-1)} = -V^{(i-1)} + U_v^{(i-1)} \quad (6)$$

The equations (1) through (6) given above are schematically represented by the block diagram of FIG. 1:

Described more specifically referring to FIG. 1, there is shown a manner in which are obtained the interstand tension variation $\sigma^{(i-1)}$, the downstream side thickness variation $h_f^{(i)}$ and the roll force variation $P^{(i)}$, based on the roll gap command value $U_s^{(i)}$ and the rolling speed command value $U_v^{(i-1)}$.

In the block diagram of FIG. 1, the roll gap output value $S_c^{(i)}$ is obtained by integration at Block 30, based on the received roll gap command value $U_s^{(i)}$, and according to the equation (5). The disturbances $d_s$ are added to the roll gap output value $S_c^{(i)}$, at Point 32, whereby the roll gap variation $S^{(i)}$ expressed by the equation (4) is determined.

In the meantime, a rolling speed output value $V^{(i-1)}$ is obtained by integration at Block 34, based on the received rolling speed command value $U_v^{(i-1)}$, and according to the equation (6). The disturbances $d_v$ are added to the rolling speed output value $V^{(i-1)}$ at Block 36, and a sum obtained in this block is multiplied by the factor Mv, at Block 38. To a product obtained at Block 38, there are added, at Block 44, a product of the roll gap variation $S^{(i)}$ and the factor Ms, which is obtained at Block 40, and a product of the upstream side thickness variation $h_b^{(i)}$ and the factor Mh, which is obtained at Block 42. Then, at Block 46, the interstand tension variation $\sigma^{(i-1)}$ is obtained by integration at Block 46, based on a sum obtained at Block 44, and according to the equation (2).

Further, the downstream side thickness variation $h_f^{(i)}$ expressed by the equation (1) is determined at Block 54, based on a sum of the following four values: the roll gap variation $S^{(i)}$ multiplied by a factor $\epsilon_s$ at Block 48; the interstand tension variation $\sigma^{(i-1)}$ multiplied by a factor $\epsilon\sigma$ at Block 50; the upstream side thickness variation $h_b^{(i)}$ multiplied by a factor $\epsilon h$ at Block 52; and the disturbances $d_h$.

The roll force variation $P^{(i)}$ expressed by the equation (3) is determined, based on the roll gap variation $S^{(i)}$ and the downstream side thickness variation $h_f^{(i)}$.

There will next be described a manner in which the rolling speed command value $U_v^{(i-1)}$ and the roll gap command value $U_s^{(i)}$ are obtained based on the detectable values, i.e., based on the interstand tension variation $\sigma^{(i-1)}$, upstream side thickness variation $h_b^{(i)}$, downstream side thickness variation $h_f^{(i)}$, and roll force variation $P^{(i)}$. This procedure is reversed with respect to the procedure indicated above.

It is noted that the variations in thickness and tension of the strip being rolled occur due to the various disturbances $d_h$, $d_v$, $d_s$, $h_b^{(i)}$ received by the rolling mill. If the amounts of these disturbances can be accurately determined or estimated, the rolling speed command values $U_v^{(i-1)}$ and the roll gap command values $U_s^{(i)}$ can be accurately determined. In the presence of the disturbances $d_s$, for example, both the downstream side thickness variation $h_f^{(i)}$ and the interstand tension $\sigma^{(i-1)}$ will vary. In this case, the thickness $h_f^{(i)}$ and the tension $^{(i-1)}$ should be controlled by adjusting only the rolling gap command value $U_s^{(i)}$. If the rolling mill is subject to the disturbances $d_v$, only the rolling speed command value $U_v^{(i-1)}$ should be adjusted. In the presence of the disturbances $d_h$, it is required that the influence on the downstream side thickness $h_f^{(i)}$ is compensated for by a roll gap adjustment $[(-1/\epsilon_s)d_h]$, while the influence of the roll gap variation on the interstand tension $\sigma(i-1)$ is compensated for by a rolling speed adjustment $[(Ms/Mv)\ (1/\epsilon_s)d_h]$.

Accordingly, the adjustments of the roll gap and the rolling speed in response to the received disturbances $d_h$, $d_v$, $d_s$ and $h_b^{(i)}$ may be accomplished according to the following equations (7) and (8):

$$U_s^{(i)} = -d_s - \frac{1}{\epsilon_s} d_h - \frac{\epsilon_h}{\epsilon_s} h_b^{(i)} \tag{7}$$

$$U_v^{(i-1)} = -d_v + \frac{M_s}{M_v} \frac{1}{\epsilon_s} d_h - \frac{M_h}{M_v} h_b^{(i)} \tag{8}$$

As described above, the roll gap and the rolling speed should be simultaneously adjusted to cope with the disturbances $d_h$. However, if there exists a considerable difference between an operating response Ts of the roll gap controller and an operating response Tv of the rolling speed controller, determination of the command values $U_s^{(i)}$ and $U_v^{(i-1)}$, according to the above equations (7) and (8), suffers from transient absence of the concurrence of the roll gap and rolling speed adjustments in response to the disturbances $d_h$ and $h_b^{(i)}$. Therefore, in the event of a considerable difference between the above-indicated operating response values Ts and Tv, the following equations (7') and (8') are preferably used in place of the above-indicated equations (7) and (8).

$$U_s^{(i)} = \left(1 - \frac{T_s}{T_s'}\right) S_c^{(i)} + \frac{T_s}{T_s'}\left(-d_s - \frac{1}{\epsilon_s} d_h - \frac{\epsilon_h}{\epsilon_s} h_b^{(i)}\right) \tag{7'}$$

$$U_v^{(i-1)} = \left(1 - \frac{T_v}{T_v'}\right) V^{(i-1)} + \frac{T_v}{T_v'}\left(-d_v + \frac{M_s}{M_v} \frac{1}{\epsilon_s} d_h - \frac{M_h}{M_v} h_b^{(i)}\right) \tag{8'}$$

The first terms of the equations (7') and (8') are feedback values, compensating for the operating response values Ts, Tv of the roll gap and rolling speed controllers. Ts' and Tv' are respective time constants of the controllers after the compensation. Suppose Ts'=Tv', the operating response values of the two controllers are made equal to each other. The second terms Ts/Ts' and Tv/Tv' of the equations (7') and (8') are compensation values for the variations in the gains due to the feedback values of the first terms for the operating response compensation.

While the dynamic conversions from the roll gap command value $U_s^{(i)}$ and rolling speed command value $U_v^{(i-1)}$ to the actually detected roll gap and rolling speed variations $S_c^{(i)}$ and $V^{(i-1)}$ are expressed by the equations (5) and (6), the latter values $S_c^{(i)}$ and $V^{(i-1)}$ are expressed as transfer functions by the following equations (A-1) and (A-2):

$$S_c^{(i)} = \frac{1}{T_s\, s + 1} U_s^{(i)} \tag{A-1}$$

$$V^{(i-1)} = \frac{1}{T_v\, s + 1} U_v^{(i-1)} \tag{A-2}$$

where, $s$: Laplace operator

By substituting the right members of the equations (7') and (8') for the values $U_s^{(i)}$ and $U_v^{(i-1)}$ of the above equations (A-1) and (A-2), the following equations (A-3) and (A-4) are obtained:

$$S_c^{(i)} = \frac{1}{T_s\, s + 1} \cdot \left\{\left(1 - \frac{T_s}{T_s'}\right) S_c^{(i)} + \frac{T_s}{T_s'}\left(-d_s - \frac{1}{\epsilon_s} d_h - \frac{\epsilon_h}{\epsilon_s} h_b^{(i)}\right)\right\} \tag{A-3}$$

$$V^{(i-1)} = \frac{1}{T_v\, s + 1} \cdot \left\{\left(1 - \frac{T_v}{T_v'}\right) V^{(i-1)} + \frac{T_v}{T_v'}\left(-d_v + \frac{M_s}{M_v} \frac{1}{\epsilon_s} d_h - \frac{M_h}{M_v} h_b^{(i)}\right)\right\} \tag{A-4}$$

The above equations (A-3) and (A-4) are transformed into the following equations (A-5) and (A-6), respectively:

$$S_c^{(i)} = \frac{1}{T_s'\, s + 1} \cdot \left(-d_s - \frac{1}{\epsilon_s} d_h - \frac{\epsilon_h}{\epsilon_s} h_b^{(i)}\right) \tag{A-5}$$

$$V^{(i-1)} = \frac{1}{T_v'\, s + 1} \cdot \left(-d_v + \frac{M_s}{M_v} \frac{1}{\epsilon_s} d_h - \frac{M_h}{M_v} h_b^{(i)}\right) \tag{A-6}$$

Suppose Ts'=Tv', the operating response values of the roll gap and rolling speed controllers which receive the command values $U_s^{(i)}$ and $U_v^{(i-1)}$ to obtain the actual roll gap and rolling speed variations $S_c^{(i)}$ and $V^{(i-1)}$ are made equal to each other, even in the presence of the disturbances. To practice the equations (7') and (8'), the disturbance values $d_s$, $d_v$, $d_h$, $h_b^{(i)}$ and the actual variation values $S_c^{(i)}$ and $V^{(i-1)}$ are required to be known. Hereunder are described the manner in which these values are estimated based on the detected strip thickness and tension values and roll force value. The upstream thickness value $h_b^{(i)}$ is detected by a thickness gauge disposed on the upstream side of the (i)th rolling stand, more precisely, between the (i)th and (i−1) stands.

(1) How To Estimate $d_h$

The following equation (9) is obtained from the equations (1) and (3):

$$d_h = \frac{P^{(i)}}{M^{(i)}} - (\epsilon_s - 1)\, S^{(i)} - \epsilon_\sigma\, \sigma^{(i-1)} - \epsilon_h h_b^{(i)} \tag{9}$$

Since the values $P^{(i)}$, $\sigma^{(i-1)}$ and $h_b^{(i)}$ can be detected by a load cell, a tension meter and the upstream side thickness gauge, respectively, the disturbance value $d_h$ can be obtained if the value $S^{(i)}$ is known or determined. The value $S^{(i)}$ can be determined based on the values Sc(i) and $d_s$, and according to the equation (4).

(2) How To Estimate $d_s$ and $S_c^{(i)}$

The disturbance $d_s$ expressed by the following equation (10) is used by way of example:

$$\frac{d}{dt}\, d_s = 0 \tag{10}$$

The above equation (10) means that the disturbance value $d_s$ is constant. Where the variation of the value $d_s$ is sufficiently small, the equation (10) may be used. Where the value $d_s$ varies to a considerable extent, the following equation (11) for high-order differentiation:

$$\frac{d^n}{dt^n}\, d_s = 0 \tag{11}$$

where, n: Integer equal to "2" or larger

There will be described a manner in which the disturbance value $d_s$ is estimated according to the equation (10). However, the value $d_s$ may be estimated in the same manner, by using the equation (11).

Suppose the estimated values of the disturbance $d_s$ and roll gap output value $S_c^{(i)}$ are expressed as $\hat{d}_s$ and $\hat{S}_c^{(i)}$, respectively, the estimated disturbance value $d_s$ is obtained according to the following equations (12) and (13):

$$\frac{d}{dt}\begin{bmatrix}\hat{S}_c^{(i)}\\ \hat{d}_s\end{bmatrix} = \begin{bmatrix}-1/T_s & 0\\ 0 & 0\end{bmatrix}\begin{bmatrix}\hat{S}_c^{(i)}\\ \hat{d}_s\end{bmatrix} + \begin{bmatrix}-1/T_s\\ 0\end{bmatrix} U_s^{(i)} + \begin{bmatrix}K_1\\ K_2\end{bmatrix}(h_f^{(i)} - \hat{h}_f^{(i)}) \tag{12}$$

$$\hat{h}_f^{(i)} = \hat{S}_c^{(i)} + \hat{d}_s + \frac{P^{(i)}}{M^{(i)}} \tag{13}$$

$$U_s^{(i)} = \left(1 - \frac{T_s}{T_s'}\right)\hat{S}_c^{(i)} + \frac{T_s}{T_s'}\left(-\hat{d}_s - \frac{1}{\epsilon_s}\hat{d}_h - \frac{\epsilon_h}{\epsilon_s} h_b^{(i)}\right) \tag{14}$$

$$\hat{d}_h = \frac{P^{(i)}}{M^{(i)}} - (\epsilon_s - 1)(\hat{S}_c^{(i)} + \hat{d}_s) - \epsilon_\sigma\, \sigma^{(i-1)} - \epsilon_h h_b^{(i)} \tag{15}$$

where, $h_f^{(i)}$: Downstream side thickness variation

K1, K2: Gains for adjusting the speeds at which the values $\hat{S}_c^{(i)}$ and $\hat{d}_s$ are obtained The value $\hat{h}_f^{(i)}$ is the downstream side thickness variation which is obtained from the estimated values $\hat{S}_c^{(i)}$ and $\hat{d}_s$, and a value $(h_f^{(i)} - \hat{h}_f^{(i)})$ is an estimated error of the downstream side thickness variation. The first and second terms of the right member of the equation (12) are the roll gap variation and the disturbance value which are expressed by the equations (5) and (10). The estimated values $(\hat{d}_s, \hat{S}_c^{(i)})$ obtained according to the equation (10) are corrected by the estimated error $(h_f^{(i)} - \hat{h}_f^{(i)})$. The following equations (16) and (17) are obtained by processing the equations (12), (13), (14) and (15):

$$\frac{d}{dt}\begin{bmatrix}\hat{S}_c^{(i)}\\ \hat{d}_s\end{bmatrix} = \begin{bmatrix}-\frac{1}{\epsilon_s}\frac{1}{T_s'} - K_1 & -\frac{1}{\epsilon_s}\frac{1}{T_s'} - K_1\\ -K_2 & -K_2\end{bmatrix}\begin{bmatrix}\hat{S}_c^{(i)}\\ \hat{d}_s\end{bmatrix} + \begin{bmatrix}K_1\\ K_2\end{bmatrix} h_f^{(i)} + \begin{bmatrix}-\frac{1}{\epsilon_s}\frac{1}{T_s'} - K_1\\ -K_2\end{bmatrix}\frac{P^{(i)}}{M^{(i)}} + \begin{bmatrix}\frac{\epsilon_\sigma}{\epsilon_s}\frac{1}{T_s'}\\ 0\end{bmatrix}\sigma^{(i-1)} \tag{16}$$

$$U_s^{(i)} = \begin{bmatrix}1 - \frac{1}{\epsilon_s}\frac{T_s}{T_s'} & -\frac{1}{\epsilon_s}\frac{T_s}{T_s'}\end{bmatrix}\begin{bmatrix}S_c^{(i)}\\ d_s\end{bmatrix} - \frac{T_s}{T_s'}\frac{1}{\epsilon_s}\frac{P^{(i)}}{M^{(i)}} + \frac{T_s}{T_s'}\frac{\epsilon_\sigma}{\epsilon_s}\sigma^{(i-1)} \tag{17}$$

The equation (16) is a formula for estimating the disturbance value $d_s$ and the roll gap variation $S_c^{(i)}$, and the equation (17) is a formula for determining the roll gap command value $U_s^{(i)}$.

The disturbance value $d_h$ is estimated by the equation (15).

(3) How To Estimate $d_v$ and $V^{(i-1)}$

Like the values ds and $S_c^{(i)}$, the disturbance value $d_v$ and the rolling speed variation $V^{(i-1)}$ are estimated in the following manner:

$$\frac{d}{dt}\begin{bmatrix}\hat{V}^{(i-1)}\\ \hat{d}_v\end{bmatrix} = \begin{bmatrix}-1/T_v & 0\\ 0 & 0\end{bmatrix}\begin{bmatrix}\hat{V}^{(i-1)}\\ \hat{d}_v\end{bmatrix} + \begin{bmatrix}1/T_v\\ 0\end{bmatrix} U_v^{(i-1)} + \begin{bmatrix}K_3\\ K_4\end{bmatrix}(\hat{y}_r^{(i-1)} - y_r^{(i-1)}) \tag{18}$$

$$\hat{y}_r^{(i-1)} = M_v(\hat{V}^{(i-1)} + \hat{d}_v) + M_s(\hat{S}_c^{(i)} + \hat{d}_s) \tag{19}$$

$$y_r^{(i-1)} = \frac{d}{dt}\sigma^{(i-1)} - M_\sigma\, \sigma^{(i-1)} - M_h h_b^{(i)} \tag{20}$$

$$U_v^{(i-1)} = \left(1 - \frac{T_v}{T_v'}\right)\hat{V}^{(i-1)} + \frac{T_v}{T_v'}\left(-\hat{d}_v + \frac{M_s}{M_v}\frac{1}{\epsilon_s}\hat{d}_h - \frac{M_h}{M_v} h_b^{(i)}\right) \tag{21}$$

where, $V^{(i-1)}$: Estimated value of $V^{(i-1)}$ $d_v$: Estimated value of $d_v$ K3, K4: Gains for adjusting the speed at which the values $\hat{V}^{(i-1)}$ and $\hat{d}_v$ are obtained The value $y_r^{(i-1)}$ is obtained by actually detecting the interstand tension value, and the value $\hat{y}_r^{(i-1)}$ is an estimated value of $y_r^{(i-1)}$. When the value $\hat{y}_r^{(i-1)}$ is correctly estimated from the equation (20), an equation $y_r^{(i-1)}-\hat{y}_r^{(i-1)}=0$ is satisfied. Therefore, an estimated error of $V^{(i-1)}$ and $d_v$ is obtained as $[y_r^{(i-1)}-\hat{y}_r^{(i-1)}]$.

The following equations (22), (23), (24) and (25) are obtained by processing the above equations (15), (18), (19), (20) and (21):

$$\frac{d}{dt}\begin{bmatrix}\hat{V}^{(i-1)}+K_3\sigma^{(i-1)}\\ \hat{d}_v+K_4\sigma^{(i-1)}\end{bmatrix}= \tag{22}$$

$$\begin{bmatrix}-1/T_v'+K_3M_v & -1/T_v'+K_3M_v\\ K_4M_v & K_4M_v\end{bmatrix}\begin{bmatrix}\hat{V}^{(i-1)}+K_3\sigma^{(i-1)}\\ \hat{d}_v+K_4\sigma^{(i-1)}\end{bmatrix}+$$

$$\begin{bmatrix}-\frac{1}{T_v'}\ \frac{M_s}{M_v}\ \frac{\epsilon_s-1}{\epsilon_s}+K_3M_s\\ K_4M_s\end{bmatrix}f(t)+$$

$$\begin{bmatrix}\frac{1}{T_v'}\ \frac{M_s}{M_v}\ \frac{1}{\epsilon_s}\\ 0\end{bmatrix}\frac{p^{(i)}}{M^{(i)}}+\begin{bmatrix}v_1\\ v_2\end{bmatrix}\sigma^{(i-1)}+$$

$$\begin{bmatrix}-\frac{1}{T_v'}\ \frac{M_h}{M_v}+K_3M_h\\ K_4M_h\end{bmatrix}h_b^{(i)}$$

$$f(t)=\hat{S}_c^{(i)}+\hat{d}_s \tag{23}$$

$$v_1=-(K_3+K_4)(-1/T_v'+K_3M_v)+ \tag{24}$$

$$K_3M_\sigma-\frac{1}{T_v'}\ \frac{M_s}{M_v}\ \frac{\epsilon_\sigma}{\epsilon_s}$$

$$v_2=-(K_3+K_4)\,K_4M_v+K_4M_\sigma \tag{25}$$

The equation (22) is a formula for estimating $(\hat{V}^{(i-1)}+K3\sigma^{(i-1)})$ and $(\hat{d}_v+K4\sigma^{(i-1)})$. The rolling speed command value $U_v^{(i-1)}$ expressed by the equation (21) is obtained from the following equation (26):

$$U_v^{(i-1)}= \tag{26}$$

$$\begin{bmatrix}1-\frac{T_v}{T_v'}-\frac{T_v}{T_v'}\end{bmatrix}\begin{bmatrix}\hat{V}^{(i-1)}+K_3\sigma^{(i-1)}\\ \hat{d}_v+K_4\sigma^{(i-1)}\end{bmatrix}+$$

$$\frac{T_v}{T_v'}\ \frac{M_s}{M_v}\ \frac{1}{\epsilon_s}\ \frac{p^{(i)}}{M^{(i)}}-\frac{T_v}{T_v'}\ \frac{M_s}{M_v}\ \frac{\epsilon_s-1}{\epsilon_s}f(t)+$$

$$\left\{\frac{T_v}{T_v'}K_3+\frac{T_v}{T_v'}K_4-K_3-\frac{T_v}{T_v'}\ \frac{M_s}{M_v}\ \frac{\epsilon_\sigma}{\epsilon_s}\right\}\sigma^{(i-1)}-$$

$$\frac{T_v}{T_v'}\ \frac{M_s}{M_v}h_b^{(i)}$$

Figure 2:
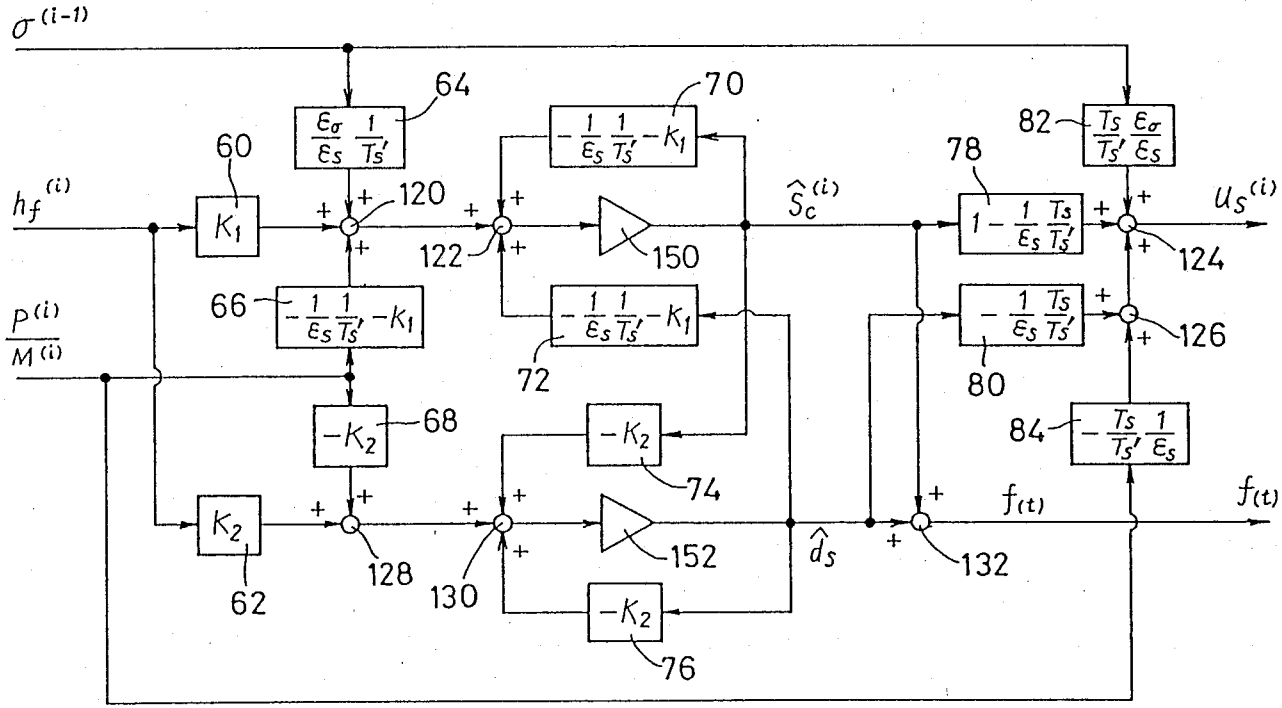
FIG. 2 is a schematic block diagram showing an example of a process for estimating mill environment disturbances from values obtained in the process of FIG. 1, and thereby determining a roll gap command value based on the estimated disturbances.
Figure 3:
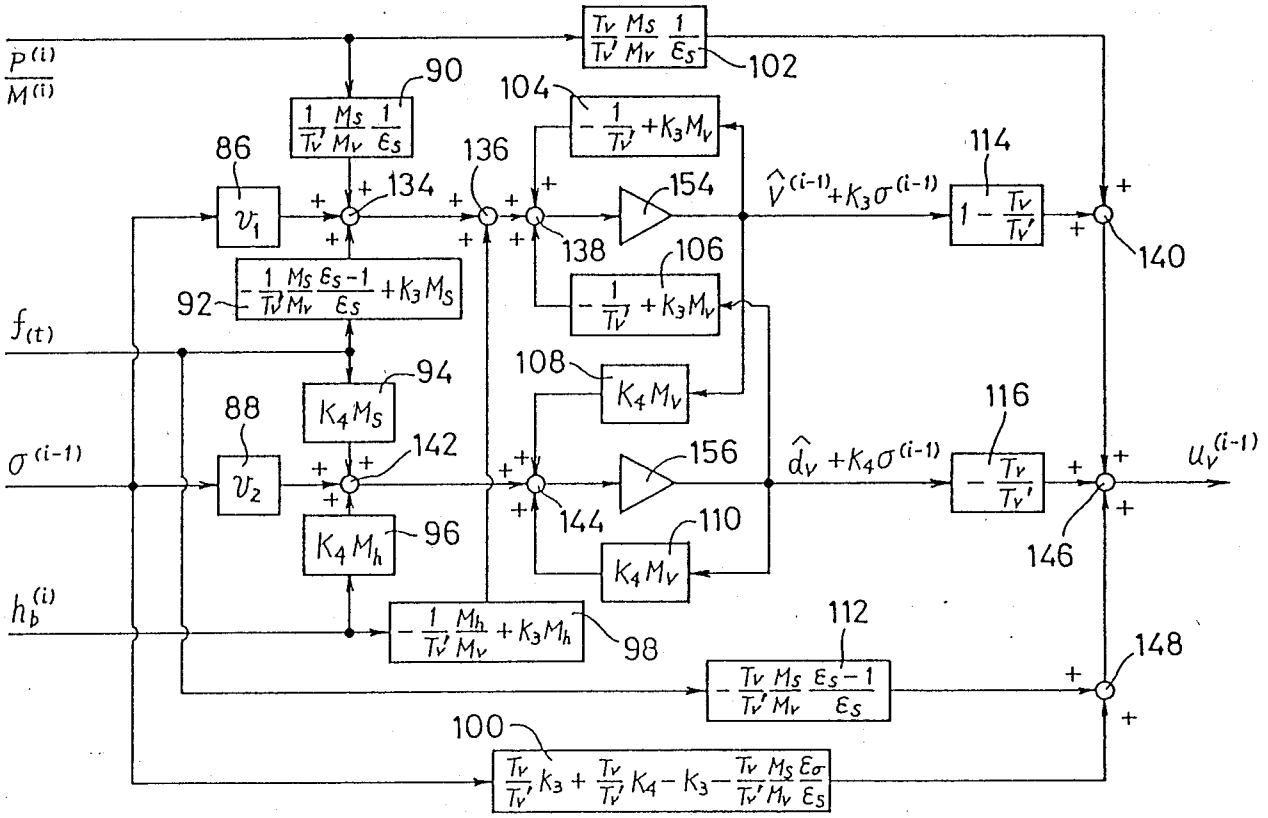
FIG. 3 is a schematic block diagram showing an example of a process for determining a rolling speed command value based on the estimated disturbances.

It will be understood from the foregoing explanation that the equations (16), (17), (22) and (26) are formulas for controlling the thickness of the strip being rolled, which are schematically indicated by the block diagrams of FIGS. 2 and 3.

If it is not necessary to adjust the operating response values of the roll gap controller and rolling speed controller, Ts=Ts' while Tv=Tv' in the equations indicated in the preceding paragraph.

To practice the method indicated by the block diagrams of FIGS. 2 and 3, gain setters 60–116, adders 120–148 and integrators 150–154 are used. The block diagram of FIG. 2 illustrates the manner in which the roll gap command value $U_s^{(i)}$ is obtained from the detectable values of the interstand tension variation $\sigma^{(i-1)}$, downstream side thickness variation $h_f^{(i)}$, and roll force variation $P^{(i)}$ at the (i)th stand.

In the block diagram of FIG. 2, the interstand tension variation $\sigma^{(i-1)}$, the downstream side thickness variation $h_f^{(i)}$, and the roll force variation $P^{(i)}$ divided by the (i)th stand constant $M^{(i)}$ are processed by the gain setters 64, 60, 66, respectively, and the processed values are summed by the adder 120. In the meantime, the roll force variation $P^{(i)}$ divided by the constant $M^{(i)}$, and the downstream side thickness variation $h_f^{(i)}$ are processed by the gain setters 68, 62, respectively, and the processed values are summed by the adder 128.

An output of the adder 120 is applied to the integrator 150 through the adder 122, and an output of the integrator 150 is fed back to the adder 122 via the gain setter 70. To the adder 122, there is also fed back through the gain setter 72 an output of the integrator 152 which receives an output of the adder 130. The output of the integrator 150 is the estimated value $\hat{S}_c^{(i)}$ of the roll gap variation $S_c^{(i)}$.

The output of the adder 128, which is applied to the integrator 152 through the adder 130 as described above, is fed through the gain setter 76 back to the adder 130. To this adder 130 is fed back through the gain setter 74 the output of the integrator 150. The output of the integrator 152 is the estimated value $\hat{d}_s$ of the disturbance $d_s$.

The estimated disturbance value $\hat{d}_s$, and the (i)th stand roll force $P^{(i)}$ divided by the constant $M^{(i)}$ are applied to the adder 126 through the respective gain setters 80, 84.

An output of the gain setter 82 which receives the interstand tension variation $\sigma^{(i-1)}$, an output of the gain setter 78, and an output of the adder 126 are summed by the adder 124, whereby the roll gap command value $U_s^{(i)}$ is determined.

Further, the outputs of the integrators 150 and 152 are applied to the adder 132, and an output of the adder 132 is used as a value f(t) as indicated in the block diagram of FIG. 3.

Referring further to FIG. 3, there is illustrated the manner in which the rolling speed command value $U_v^{(i-1)}$ is determined from the interstand tension variation $\sigma^{(i-1)}$, upstream side thickness variation $h_b^{(i)}$, downstream side thickness variation $h_f^{(i)}$ and roll force variation $P^{(i)}$.

In the block diagram of FIG. 3, the roll force variation $P^{(i)}$ divided by the constant $M^{(i)}$, the output f(t) of the adder 132, and the interstand tension variation $\sigma^{(i-1)}$ are applied to the respective gain setters 90, 92, 86, and are summed by the adder 134. In the meantime, the value f(t), interstand tension variation $\sigma^{(i-1)}$ and upstream side thickness variation $h_b^{(i)}$ are applied to the respective gain setters 94, 88 and 96, and are summed by the adder 142.

An output of the adder 134, and an output of the gain setter 98 are summed by the adder 136, and an output of the adder 136 is applied to the adder 138, and then to the integrator 154. An output of the integrator 154 is fed back to the adder 138 through the gain setter 104. To this adder 138, there is also fed back through the gain setter 106 an output of the integrator 156 which receives an output of the adder 144.

An output of the adder 142, which is applied to the integrator 156 through the adder 144 as described above, is fed back to the adder 144 through the gain setter 110. To this adder 144, there is fed back through the gain setter 108 an output of the integrator 154 which receives an output of the adder 138.

Further, the value f(i) and the interstand tension variation $\sigma^{(i-1)}$ are applied to the respective gain setters 112, 100, and summed by the adder 148.

The roll force variation $P^{(i)}$ divided by the constant $M^{(i)}$, and the output of the integrator 154 are applied to the adder 140 through the respective gain setters 102, 114.

The output of the adder 140, an output of the gain setter 116 which receives an output of the integrator 156, and an output of the adder 148 are applied to the adder 146, whereby the rolling speed command value $U_v^{(i-1)}$ is determined.

Figure 4:
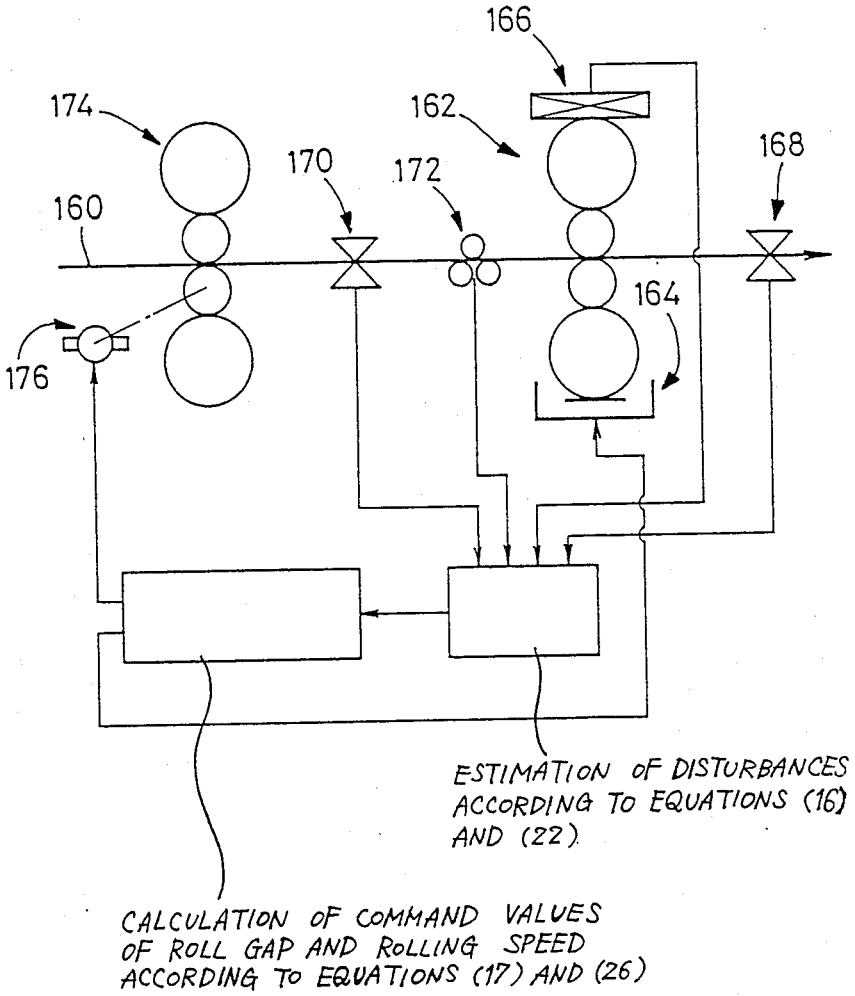
FIG. 4 is a schematic view of an example of the rolling mill controlled according to the present invention.
Figure 5A:
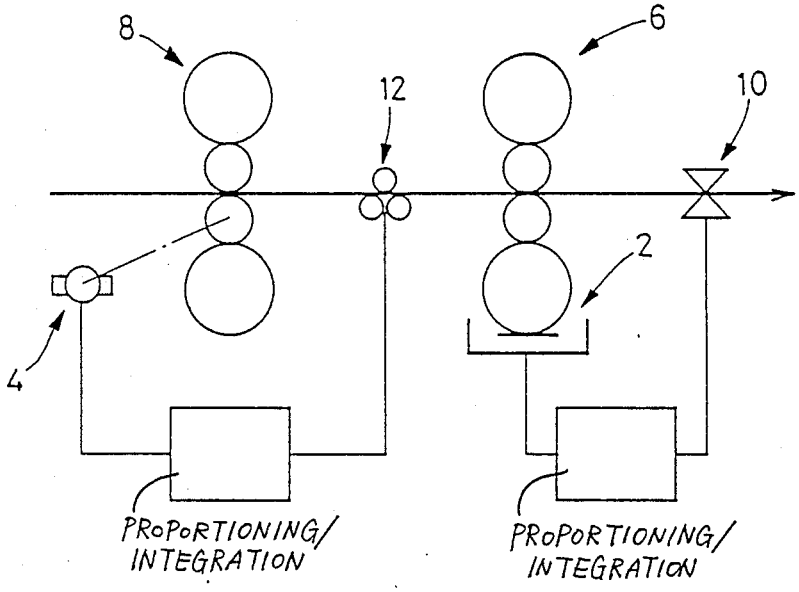
FIG. 5(a) PRIOR ART
FIG. 5(*a*) is a schematic view of a known control system for a rolling mill.
Figure 5B:
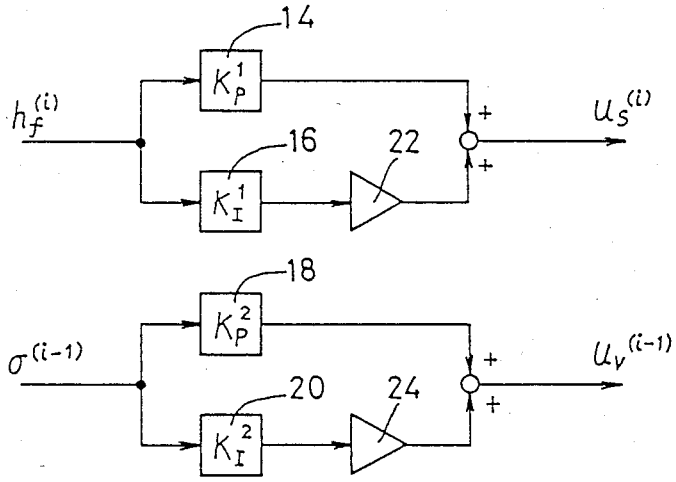
FIG. 5(b) PRIOR ART

FIG. 4 shows an example of a rolling mill in the form of an aluminum cold tandem rolling mill, which is controlled according to the principle of the present invention. In the figure, reference numeral 160 designates an aluminum strip being rolled. The rolling mill has a hydraulically operated roll gap adjusting actuator 164 for adjusting the roll gap of the (i)th rolling stand 162. This rolling stand 162 is provided with a load cell 166 for detecting a force which is exerted on the work rolls of the stand. The rolling mill uses a downstream side thickness gauge 168 on the downstream side of the rolling stand 162, for detecting a variation in the thickness of the strip 160 on the downstream side of the stand 162. The rolling mill further uses an upstream side thickness gauge 170 and an interstand tension meter 172, which are positioned between the (i)th stand 162, and the (i−1)th rolling stand 174 which precedes the (i)th stand 162, as viewed in the rolling direction. The (i−1)th stand 174 is provided with a rolling speed adjusting device 176 for adjusting the rolling speed.

Outputs of the load cell 166, downstream side thickness gauge 168, upstream side thickness gauge 170 and interstand tension meter 172 are processed according to the equations (16) and (22), in order to estimate the rolling environment disturbances which have been described. Based on the estimated disturbance values, the roll gap command value and the rolling speed command value which are applied to the roll gap adjusting actuator 164 and the rolling speed adjusting device 176 are calculated according to the equations (17) and (26), as described above, so as to compensate for the disturbances. The actuator 164 and the device 176 are controlled according to the determined command values.

While the rolling mill of FIG. 4 is a tandem type, the principle of the invention is applicable to a single-stand rolling mill. In this case, the rolling speed command value is applied to a pay-off reel. In the case of a tandem rolling mill having a plurality of rolling stands, the control method and device according to the invention are applicable to the desired rolling stands.

Although the rolling mill shown in FIG. 4 is adapted to roll an aluminum strip, the invention may be equally practiced for rolling a strip of any other metals.

While the invention has been described in its presently preferred embodiment with a certain degree of particularity, it is to be understood that the invention is not limited to the precise details of the illustrated embodiment, but may be embodied with various changes, modifications and improvements, which may occur to those skilled in the art, without departing from the spirit and scope of the invention defined in the following claims.

What is claimed is:

1. A method of controlling a thickness of a strip in a rolling mill which has a roll gap adjusting device for adjusting a roll gap of a given rolling stand of the mill, and a rolling speed adjusting device for adjusting a rolling speed of the strip, comprising the steps of:

detecting a variation of a roll force exerted on said given rolling stand, a variation of a thickness of said strip on an upstream side of said rolling stand, a variation of a thickness of said strip on a downstream side of said rolling stand, and a variation of a tension of said strip on said upstream side of said rolling stand;

classifying rolling environment disturbances received by said rolling mill into a first disturbance for which only said rolling speed should be compensated, a second disturbance for which only said roll gap should be compensated, and a third disturbance for which both said rolling speed and said roll gap should be compensated;

estimating values of said first, second and third disturbances, based on the detected variation of said roll force, the detected variation of the thickness of said strip on the upstream and downstream sides of said rolling stand, and the detected variation of said tension of said strip on said upstream side of said rolling stand; and operating said roll gap adjusting device and said rolling speed adjusting device, depending upon the estimated values of said first, second and third disturbances, to thereby control the thickness of said strip, such that only said rolling speed is adjusted by said rolling speed adjusting device for said first disturbance, while only said roll gap is adjusted by said roll gap adjusting device for said second disturbance, and such that both said rolling speed and said roll gap are adjusted for said third disturbance.

2. A method according to claim 1, wherein the step of estimating the values of said first, second and third disturbances is effected according to equations (22), (16) and (15), respectively, and the step of operating said roll gap and rolling speed adjusting devices is effected according to equations (17) and (26), respectively.

3. A method according to claim 1, wherein said rolling mill is a cold tandem rolling mill having a plurality of rolling stands which includes said given rolling stand.

4. A method according to claim 1, wherein said strip consists of an aluminum strip.

5. A device for controlling a thickness of a strip in a rolling mill which has a plurality of rolling stands, comprising:

a roll gap adjusting device for adjusting a roll gap of a given one of said plurality of rolling stands, through which said strip is passed for being rolled, giving the rolled strip a desired value of thickness;

a rolling speed adjusting device for adjusting a rolling speed of said strip at a preceding one of said plurality of rolling stands which precedes said rolling stand;

roll force detecting means for detecting a variation of a roll force exerted on said rolling stand;

upstream thickness detecting means for detecting a variation of a thickness of said strip on an upstream side of said rolling stand;

downstream thickness detecting means for detecting a variation of a thickness of said strip on a downstream side of said rolling stand;

tension detecting means for detecting a variation of a tension of said strip on said upstream side of said rolling stand; and arithmetic means receiving outputs of said roll force detecting means, said downstream and upstream thickness detecting means, and said tension detecting means, so as to classify rolling enviroment disturbances received by said rolling mill into a first disturbance for which only said rolling speed should be compensated, a second disturbance for which only said roll gap should be compensated, and a third disturbance for which both said roll gap and said rolling speed should be compensated, said arithmetic means estimating values of said first, second and third disturbances, based on the detected variation of said roll force, said thicknesses of said strip and said tension, and producing output signals for operating said roll gap adjusting device and said rolling speed adjusting device, depending upon the estimated values of said first, second and third disturbances, to thereby control the thickness of said strip, such that only said rolling speed is adjusted by said rolling speed adjusting device for said first disturbance, while only said roll gap is adjusted by said roll gap adjusting device for said second disturbance, and such that both said rolling speed and said roll gap are adjusted for said third disturbance.

* * * * *